United States Patent [19]

Turgeon

[11] Patent Number: 4,589,714

[45] Date of Patent: May 20, 1986

[54] GROUND CLIP FOR PHOTOCONDUCTIVE FILM

[75] Inventor: Thomas A. Turgeon, Fridley, Minn.

[73] Assignee: Minnesota Mining and Manufacturing Company, St. Paul, Minn.

[21] Appl. No.: 577,200

[22] Filed: Feb. 6, 1984

[51] Int. Cl.[4] ..... H01R 4/66

[52] U.S. Cl. ..... 339/14 R; 242/74

[58] Field of Search ..... 242/74, 74.1, 74.2; 339/17 F, 95 R, 14 R, 27 BA; 206/54, 412

[56] References Cited

U.S. PATENT DOCUMENTS

| | | | |
|---|---|---|---|
| 1,466,275 | 8/1923 | Denison | 242/74.2 |
| 3,528,050 | 9/1970 | Hindenburg | 339/95 R |
| 3,818,415 | 6/1974 | Evans et al. | 339/17 F |
| 4,186,981 | 2/1980 | Holton | 339/14 R |
| 4,352,469 | 10/1982 | Huck | 242/74 X |

OTHER PUBLICATIONS

Application Ser. No. 520,208—Hendrickson et al, filed Aug. 4, 1983 "Silicone Release Coatings for Efficient Toner Transfer".

*Primary Examiner*—Eugene F. Desmond

*Attorney, Agent, or Firm*—Donald M. Sell; James A. Smith; David W. Anderson

[57] ABSTRACT

A grounding clip which is provided to secure the end of a photoconductor film to a reel. The film includes a conductive layer covered by a photoconductive layer and the grounding clip is provided with barbs having sharp edges to scrape through the photoconductive layer during assembly of the clip to the reel and electrically contact the conductive layer. Assembly of the reel to a drive shaft provides an electrical connection through the grounding clip between the conductive layer of the photoconductive film and the drive shaft to ground the conductive layer of the film.

8 Claims, 8 Drawing Figures

GROUND CLIP FOR PHOTOCONDUCTIVE FILM

BACKGROUND OF THE INVENTION

1. Field of the Invention

This invention relates generally to photoconductive films having an insulated conductive layer for use with a microfilm camera, and particularly to a spring clip utilized to ground the conductive layer to the camera.

2. Description of the Prior Art

Microfilm cameras exist which may be used to transfer a greatly reduced image of an object document to a strip or card for storage and subsequent retrieval. These cameras utilize an intermediate photoconductive film for the development and subsequent transfer of the image to the strip or card. As shown in FIG. 1, the film 10 is a laminated structure which includes a polymer protective sheet 12, a thin conductive layer 14, a photoconductive layer 16 and a silicone release layer 18. The polymer sheet 12 is an insulating layer which contributes to the structural strength of the film 10 and protects the conductive layer 14, which is typically vapor-coated aluminum. The photoconductive layer 16 can be either an organic photoconductor or a dispersion of an inorganic photoconductor in particulate form dispersed in a suitable binder. The silicone release layer 18 is one of a class of film-forming silicone polymers which are described in U.S. application Ser. No. 520,208, filed by Hendrickson on Aug. 4, 1983.

The photoconductive film 10 is used within the camera in an electrographic process which involves placing a uniform electrostatic charge on the photoconductive layer 16, exposing the layer to light to dissipate the charge in areas of the layer 16 exposed to light and developing the resulting electrostatic latent image by depositing on the image area a finely divided electroscopic material commonly referred to as toner. The toner will be attracted to those areas of the photoconductive layer 16 which retain a charge, thereby forming a toned image corresponding to the electrostatic latent image. The toned image may then be transferred to a receptor surface such as a strip or card of paper or polymeric film. The conductive layer 14 is necessary to conduct the electrical charge away from the exposed areas to a suitable ground, and the silicone release layer 18 facilitates the transfer of the toner image to the receptor surface.

In order that the conductive layer 14 may effectively conduct the charge away from exposed areas, the conductive layer 14 must be grounded to the microfilm camera in which the photoconductive film 10 is used. Direct access to the conductive layer 14, however, is prevented by the polymer sheet 12 which supports and protects the conductive layer 14 and the photoconductive layer 16. In the past, it has been a practice to dissolve a portion of the photoconductive layer 16 at an end of the film 10 with a solvent in order to gain access to the conductive layer 14. This procedure is time consuming and inconvenient.

A similar problem of access to a conductor through a thin insulating film was addressed in U.S. Pat. No. 3,818,415 in which an electrical terminal was provided which included abrasive particles bonded to the surface of the terminal. An electrical connection to the film insulated conductor was obtained by sliding the conductor over the terminal surface while the two parts were held together. The abrasive particles on the terminal scored the insulating film and thereby exposed the metallic conductor. While effective, this manner of producing an electrical connection to the conductive layer 14 may result in abrasive particles being scraped from the terminal surface and interferring with the workings of the associated apparatus.

SUMMARY OF THE INVENTION

Access to the insulated conductive layer of a photoconductive film is gained without using chemical solvents or abrasive particles by providing a U-shaped grounding clip which includes sharp barbs projecting opposite the extension of legs comprising the clip and is adapted to fit the supply reel of the film. As the clip is held in contact with the film and slid relative thereto, the barbs penetrate the photoconductive layer and contact the underlying conductive layer. Contact with the clip will, therefore, provide electrical contact to the conductive layer.

BRIEF DESCRIPTION OF THE DRAWING

The present invention will be more thoroughly described with reference to the accompanying drawings wherein like numbers refer to like parts in the several views, and wherein.

DESCRIPTION OF THE PREFERRED EMBODIMENT

Figure 1:
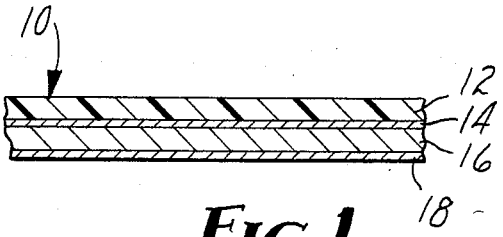
FIG. 1 is an enlarged, cross-sectional view of a portion of a photoconductive film to which electrical connection is to be made.
Figure 2:
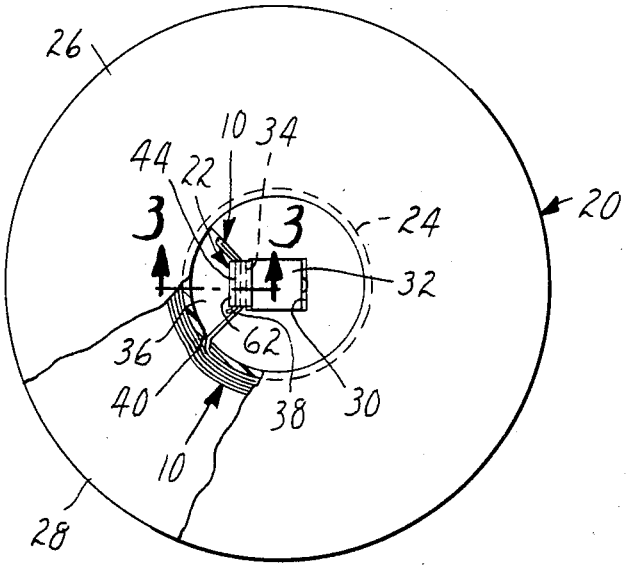
FIG. 2 is a plan view, with portions removed, of a conventional film reel, upon which the film of FIG. 1 is wound and which includes a grounding clip according to the present invention.

FIG. 1, as described earlier, represents in cross-section a photoconductive film 10 which is comprised of a polymer sheet 12, a thin conductive layer 14, a photoconductive layer 16 and a silicone release layer 18. The polymer sheet 12 functions to add strength to the film 10 and support and protect the conductive layer 14 which is vapor-coated thereon. The photoconductive film 10 is used in conjunction with a microfilm camera (not shown) wherein the film 10 is wound upon a reel 20, as seen in FIG. 2, and may be unwound for exposure to an image and subsequent transfer of this image to a microfilm strip or card. Image development and transfer is achieved by an electrographic process which involves placing a uniform electrostatic charge on the photoconductive layer 16, imagewise exposing the layer 16 to dissipate the charge on the areas of the layer 16 exposed to light, and developing the resulting electrostatic image by depositing on the image area a finely divided electroscopic material commonly referred to in the art as toner. The toner will be attracted to those areas of the layer 16 which retain a charge, thereby forming a toned image corresponding to the electrostatic latent image. The toned image may then be transferred to a receptor surface such as the polymeric film of a microfilm strip or card by pressing the film 10 under pressure against the microfilm card and applying heat. The silicone release layer 18 facilitates the transfer of the toned image from the film 10 to the microfilm card and the thin conductive layer 14 is provided to conduct electrostatic charges away from nonimage areas.

In order that this electrostatic charge may be conducted from the nonimage areas, the conductive layer 14 must be grounded to the microfilm camera. A problem associated in the past with the photoconductive film 10 is that the photoconductive layer 16 which covers the conductive layer 14 effectively insulates the conductive layer 14 and prevents the easy connection of this layer 14 to the camera ground. In the past, this photoconductive layer 16 has been removed in the desired connection area by means of a solvent and the conductive layer 14 mechanically connected to the ground plane. Such a procedure is time consuming, messy and inconvenient.

To avoid the use of solvents and still provide the electrical connection between the conductive layer 14 and the ground plane of the microfilm camera, there has been provided according to the invention a grounding clip 22 which is used to provide the required electrical connection and secure the end of the photoconductive film 10 to the reel 20.

The film reel 20 is a conventional 16 mm film reel which includes a central hub 24 around which the film 10 may be wound and side flanges 26 and 28 which contain the film on the reel 20 as it is wound and placed in the microfilm camera. The reel 20 conventionally includes a central, square bore 30 through which a square drive shaft 32 may be inserted to retain and drive the reel 20. The central bore 30 is partially defined by a web 34 which separates the bore 30 from an open space 36 into which an end 38 of the photoconductive film 10 may be inserted through an aperture 40 in the reel hub 24.

Figure 3:
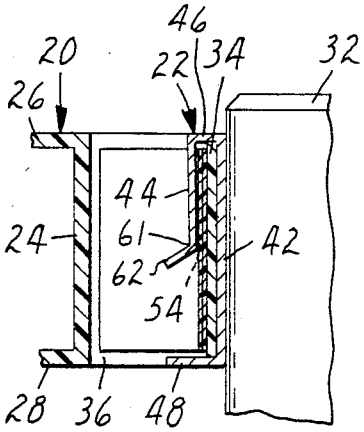
FIG. 3 is a cross-sectional, enlarged view of the ground clip of FIG. 2 taken generally along the line 3—3 of FIG. 2.
Figure 4:
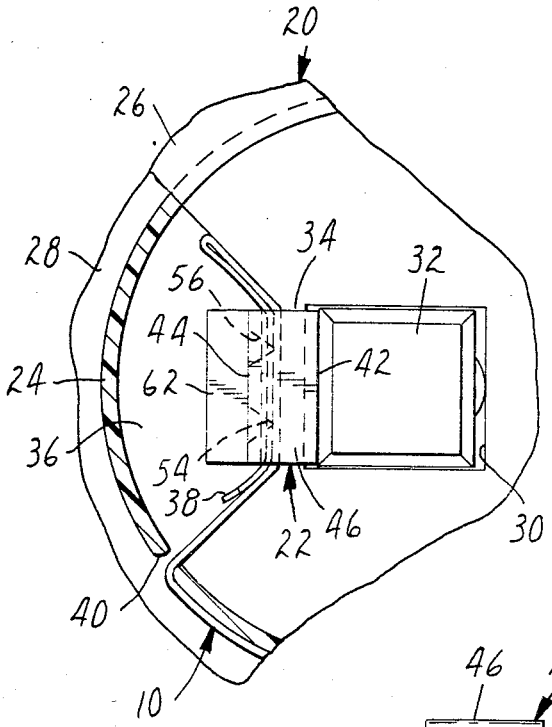
FIG. 4 is an enlarged, plan view of a portion of FIG. 2.

As may be seen in greater detail in FIGS. 3 and 4, the grounding clip 22 spans the web 34 and urges the photoconductive film 10 against the web 34 to retain the end 38 of the film 10 within the open space 36 provided in the hub 24.

The grounding clip 22 is generally U-shaped and includes legs 42 and 44 depending from a transverse crosspiece 46. The leg 42 adjacent the drive shaft 32, when the clip 22 is assembled to the reel 20, is adapted to span the web 34 and includes at its end opposite the crosspiece 46 a retaining piece 48 which is utilized in conjunction with the crosspiece 46 to capture the web 34 and retain the grounding clip 22 in position with respect to the web 34. The leg 42, as shown in FIG. 3, is oriented to the crosspiece 46 and the retaining piece 48 at angles of 90 degrees.

Figure 5:
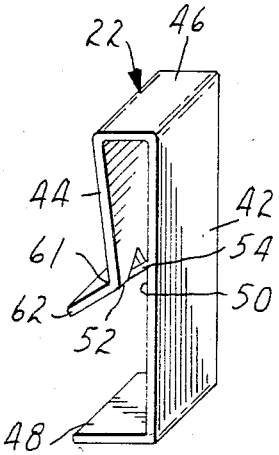
FIG. 5 is a perspective view of the grounding clip of FIG. 2.

The remaining leg 44 located adjacent the photoconductive film 10 is approximately one-half the length of the leg 42 and is oriented with respect to the crosspiece 46 at an angle less than 90 degrees so that the legs 42, 44 converge to a point of minimum spacing indicated, in FIG. 5, between the portion 50 of the leg 42 and the portion 52 of the leg 44. The spacing at this point of minimum spacing 50, 52 when the grounding clip 22 is in the undeformed state is less than the combined thickness of the web 34 and the photoconductive film 10 so that when the grounding clip 22 is assembled, as shown in FIG. 3, a compressive force is exerted between the legs 42 and 44 to retain the photoconductive film 10 in contact with the web 34.

As indicated above, the primary function of the grounding clip 22 is to ground the conductive layer 14 of the photoconductive film 10 to the microfilm camera. The ground plane of the camera is accessible at the shaft 32. To electrically connect the shaft 32 of the camera and the conductive layer 14 of the film 10, it is necessary to penetrate the photoconductive layer 16 which overlies the conductive layer 14.

Figure 6:
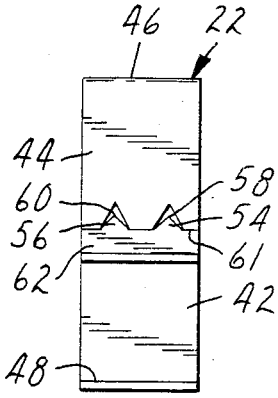
FIG. 6 is a front elevational view of the grounding clip of FIG. 2.

To penetrate the photoconductive layer 16 there are provided twin barbs 54 and 56 which are best seen in FIGS. 5 and 6. The barbs 54, 56 project opposite the extension of the legs 42, 44 from the crosspiece 46 and inwardly from the leg 44 toward the leg 42. The barbs 54, 56 terminate in sharp edges 58 and 60 which function to scrape or scratch through the photoconductive layer 16 and contact the conductive layer 14 as the grounding clip 22 is inserted over the web 34 and slid with respect to the photoconductive film 10. The barbs 54, 56 are produced by punching the material of the leg 44 and folding the leg 44 along a line 61 which corresponds to the base of the barbs 54, 56. The fold 61 of the leg 44 causes the barbs 54, 56 to project toward the leg 42 and results in the sharp edges 58 and 60 being spaced from the leg 42 a distance less than the minimum spacing 50, 52 between the legs 42 and 44.

Bending of the leg 44 at the fold 61 to achieve the desired projection of the barbs 54, 56 also results in an outwardly sloped end 62 of the leg 44 which is useful in facilitating assembly of the grounding clip 22 to the web 34 as will be described hereinafter.

Depiction of the barbs 54, 56 as triangular in shape and two in number is merely for convenience and is not necessary to the functioning of the barbs 54, 56 which is to scrape through the photoconductive layer 16 and contact the conductive layer 14. A greater or lesser number of barbs 54, 56 could be provided and, as illustrated by FIGS. 7 and 8, the shape and location of the barbs 54, 56 could be changed.

Figure 7:
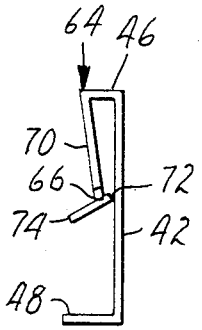
FIG. 7 is a side elevational view of an alternate embodiment of a grounding clip according to the invention.
Figure 8:
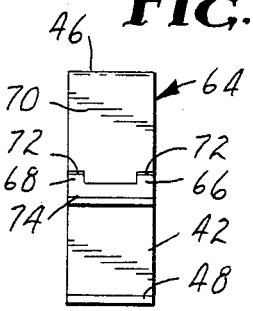
FIG. 8 is a front elevational view of the grounding clip of FIG. 7.

FIGS. 7 and 8 illustrate a grounding clip 64 which is identical to the clip 22 except for barbs 66 and 68 which are rectangular in shape and located at the edges of the leg 70 which is adjacent the photoconductive film 10 when the grounding clip 64 is assembled to the web 34. The grounding clip 64 of FIGS. 7 and 8 illustrates that the shape and location of the barbs 66, 68 may vary and still effectively contact the conductive layer 14 of the film 10 through the polymer sheet 12. The important feature of either the barbs 54, 56 of FIGS. 2-6 or the barbs 66, 68 of FIGS. 7 and 8 is that the barbs terminate in sharp edges 58, 60 or 72 adjacent the photoconductive film 10 to provide the required scraping and scratching of the photocondutive layer 16.

Assembly of the grounding clips 22 or 64 to the reel 20 and the electrical connection of the conductive layer 14 to the drive shaft 32 is accomplished by threading the photoconductive film 10 through the aperture 40 of the reel hub 24 prior to winding the film upon the reel 20 and folding the end 38 of the film 10 back on itself so that the photoconductive layer 16 faces away from the web 34. The photoconductive film 10 is then held adjacent the web 34, and, prior to assembly of the reel 20 to the shaft 32, the grounding clip 22 or 64 is positioned so that the web 34 and the photoconductive film 10 are located between the sloped end 62 of the leg 44 or the sloped end 74 of the leg 70. The grounding clip 22 or 64 is then pushed downwardly until the retaining piece 48 clears the end of the web 34 opposite the crosspiece 46 and the web 34 is captured between the retaining piece 48 and the crosspiece 46. While the grounding clip 22 or 64 is being pushed to this final assembled position, the sharp edges 58 and 60 or 72 of the grounding clips 22 or 64 scrape along the photoconductive layer 16 to scratch through this layer 16 and contact the conductive layer 14. Assembly of the reel 20 to the shaft 32 results in contact between the leg 42 and the shaft 32 and the consequent grounding of the conductive layer 14 of the film 10 and the microfilm camera.

A grounding clip has thus been described which rapidly and conveniently electrically connects the conductive layer of a photoconductor film to a ground plane of the mechanism in which the film is used and also secures the film to a reel upon which the film is wound.

It is apparent that modifications of the described embodiments will be apparent to those skilled in the art, and all such modifications falling within the spirit and scope of the appended claims are intended to be considered part of the invention.

I claim:

1. In combination with a film reel having a web partially defining a central bore adapted to accept a shaft and a laminated film wound on said reel to lie against said web opposite said shaft, said film including a conductive layer and an overlying insulating layer opposite said web, a U-shaped, flat metal ground clip adapted to span said web and form an electrical connection between said film conductive layer and said shaft comprising:

a flat, metal crosspiece spanning said web and including ends parallel to said web and adjacent said shaft and said film, said crosspiece having a length greater than the combined thicknesses of said web and said film;

a flat, metal first leg extending from said crosspiece end adjacent said shaft perpendicular to said crosspiece and between said web and said shaft;

a flat, metal second leg having a length less than or equal to the length of said first leg and extending from said end of said crosspiece adjacent said film at an acute angle toward said first leg so that the separation of said legs is a maximum at said crosspiece and a line of minimum spacing less than the combined thicknesses of said web and said film is produced between said legs at a position along said legs removed from said crosspiece whereby said film is forced against said web at said line of minimum spacing; and at least one barb projecting from said second leg toward said first leg and said crosspiece, said barb terminating in a sharp edge spaced from said first leg a distance less than said minimum spacing to penetrate said insulating layer.

2. The combination of claim 1 wherein said ground clip further includes a retaining piece extending from the end of said first leg opposite said crosspiece parallel to said crosspiece and toward said second leg, the spacing of said retaining piece from said crosspiece being sufficient to capture said web therebetween.

3. The combination according to claim 1 wherein said ground clip further includes a sloped extension extending from said second leg at said line of minimum spacing away from said first leg and said crosspiece.

4. The combination of claim 3 wherein said ground clip further includes a retaining piece extending from the end of said first leg opposite said crosspiece parallel to said crosspiece and toward said second leg, the spacing of said retaining piece from said crosspiece being sufficient to capture said web therebetween.

5. The combination of claim 1 wherein said barb extends from said second leg at said line of minimum spacing and is triangular in shape with the base of said triangular shape coinciding with said line of minimum spacing and the apex of said triangular shape extending toward said first leg and said crosspiece.

6. The combination of claim 5 wherein said ground clip further includes a retaining piece extending from the end of said first leg opposite said crosspiece parallel to said crosspiece and toward said second leg, the spacing of said retaining piece and said crosspiece being sufficient to capture said web therebetween.

7. The combination of claim 5 wherein said ground clip further includes a sloped extension extending from said second leg at said line of minimum spacing and away from said first leg and said crosspiece.

8. The combination of claim 7 wherein said ground clip further includes a retaining piece extending from the end of said first leg opposite said crosspiece parallel to said crosspiece and toward said second leg, the spacing of said retaining piece and said crosspiece being sufficient to capture said web therebetween.

* * * * *